US005099290A

United States Patent [19]

Yokota

[11] Patent Number: 5,099,290

[45] Date of Patent: Mar. 24, 1992

[54] CONTINUOUS PAPER PRINTER WITH MONITORING TIME PERIOD IN WHICH THE PAPER FEED SPEED IS LOWER THAN WHEN PRINTING

[75] Inventor: Yuji Yokota, Iwate, Japan

[73] Assignee: Kabushiki Kaisha Sato, Japan

[21] Appl. No.: 647,299

[22] Filed: Jan. 29, 1991

[30] Foreign Application Priority Data

Feb. 15, 1990 [JP] Japan ..... 2-34807

[51] Int. Cl.[5] ..... G03G 21/00

[52] U.S. Cl. ..... 355/310; 101/228; 226/30; 355/308; 358/304; 395/100

[58] Field of Search ..... 355/308, 310, 316, 317, 355/321, 204, 208, 203, 311; 226/27-30; 358/304, 296, 300, 404, 406, 401, 846; 242/56 R; 101/228; 346/155, 24, 153.1; 271/270; 364/519

[56] References Cited

U.S. PATENT DOCUMENTS 3,665,486 5/1972 Sato ..... 355/310 X 5,025,397 6/1991 Suzuki ..... 364/519

*Primary Examiner*—A. T. Grimley

*Assistant Examiner*—William J. Royer

*Attorney, Agent, or Firm*—Ostrolenk, Faber, Gerb & Soffen

[57] ABSTRACT

A continuous-paper electrophotographic printer prevents the printed paper from being either scorched or needlessly paid out during periods when printing is halted to enable receipt of a next batch of printing data. This is accomplished by reducing the paper feeding rate between printing periods. Thereby, the printer can rapidly proceed to a next printing operation when inputting of the next data to be printed is completed within a time period that is provided for checking whether the next set of print data is ready.

9 Claims, 2 Drawing Sheets

CONTINUOUS PAPER PRINTER WITH MONITORING TIME PERIOD IN WHICH THE PAPER FEED SPEED IS LOWER THAN WHEN PRINTING

BACKGROUND OF THE INVENTION

1. Field of the Invention

This invention relates to an electrophotographic printer that uses continuous paper as the printing medium 2. Description of the Background Art In conventional electrophotographic printers which use continuous paper, upon completion of a prescribed printing operation, a monitoring interval is interposed before proceeding to the next printing operation. During the monitoring interval, it is determined whether or not the next set of printing data is ready Also, during this time interval, the speed of rotation of a light-sensitive drum, of a paper transport drive roller, and of a paper ejecting roller, all of which are associated with the printer, either stays the same as it was during the printing operation or the rotation is completely halted.

Drawbacks of such conventional printer arrangements are that paper is either wasted when the feeding thereof is continued during the monitoring interval, or is caused to be scorched by the heat generated at the printing section in the event that the feeding of the paper is halted while awaiting the next set of printing data. Also, the processing speed of the system is slowed because a standby period is needed to allow the speeds of the various rotatable elements to stabilize when feeding of the paper is halted and then restarted.

SUMMARY OF THE INVENTION

Accordingly, a primary object of the invention is to avoid the aforementioned and other drawbacks of the prior art by providing a continuous-paper electrophotographic printer that prevents the paper from being scorched or wasted by needless feeding.

The printer of the present invention rapidly proceeds from a current to a next printing operation by assuming that inputting of the next data to be printed is completed within a prescribed time period To this end, when a first set of print data A is to be printed on a specific number of labels on the continuous paper, followed by the printing of a second set of print data B on a specific number of labels, the new print data B is input while the print data A is being printed Thus, the printing of the data that has already been input is completed prior to the completion of the input of the print data that is to be printed next.

The above result is attained by a continuous-paper electrophotographic printer in which, as in the prior art, a prescribed printing operation is followed by a monitoring time of a predetermined duration, at which time the readiness of a next set of print data is checked. However, in accordance with the present invention, during this period the speed of rotation of the light-sensitive drum, the paper transport drive roller and the paper eject roller is slowed below the speed thereof during printing operations. This prevents paper scorching and remedies the problem of paper wastage.

Other features and advantages of the present invention will become apparent from the following description of the invention which refers to the accompanying drawings.

DETAILED DESCRIPTION OF THE PREFERRED EMBODIMENTS

Figure 1:
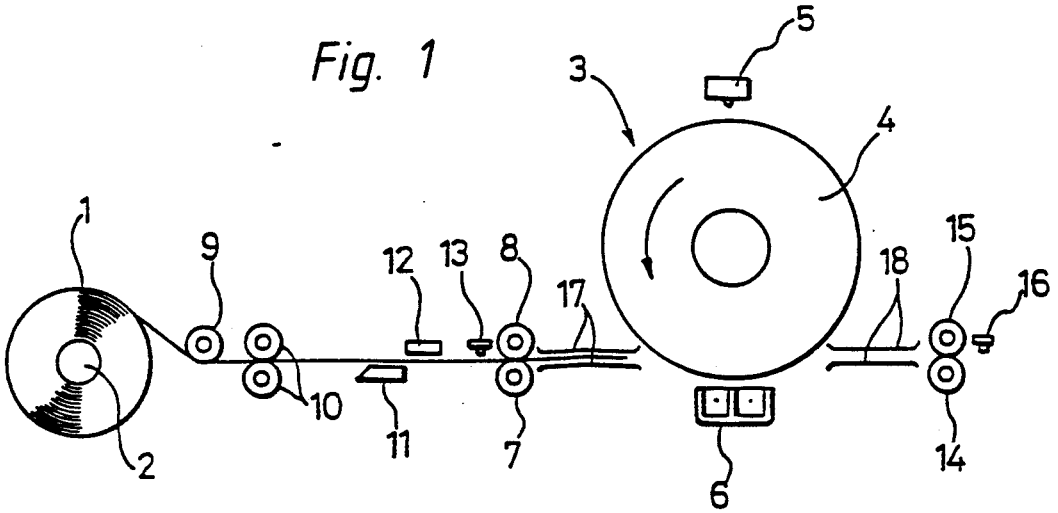
FIG. 1 is a general schematic of a first embodiment of the continuous-paper electrophotographic printer of the present invention.

With reference to FIG. 1, a roll of paper 1 comprised of a backing sheet of a certain width and coated with a separating agent has a plurality of labels of about the same width detachably adhered thereto. Each of the labels is coated with an adhesive, the labels being placed at a given pitch continuously along the length of the backing sheet. The roll of paper 1 is rotatably mounted on a paper holder in the form of a reel 2.

An electrophotographic printing section located a prescribed distance from the reel 2 is mainly constituted of a light-sensitive drum 4, a LED (light-emitting diode) head 5, and an electrophotographic transfer element 6.

A drive roller 7 and a pressure roller 8, located between the paper holder and the electrophotographic printing section 3, form a transport means for moving the paper 1. Guide rollers 9 and 10 serve to guide the paper 1. For cutting the paper 1, cutting means constituted by a fixed blade 11 and a movable blade 12 are provided between the paper holder 2 and the transport means. A paper-ready sensor 13, on the paper holder side of the transport means, detects whether or not the paper 1 is positioned ready for transport. Alternatively, the paper-ready sensor 13 may be provided on the side of the electrophotographic printing section 3 of the transport means.

An ejection means for ejecting the paper 1 comprises an ejection drive roller 14 and an ejection pressure roller 15, both rollers being located on the downstream side of the electrophotographic printing section 3 in the direction of the paper travel. An ejection sensor 16 located downstream of the ejection means serves to detect whether or not the cut paper 1 has left the electrophotographic printing section 3. Guide plates 17 and 18 are provided upstream and downstream, respectively, of the electrophotographic printing section 3.

Figure 2:
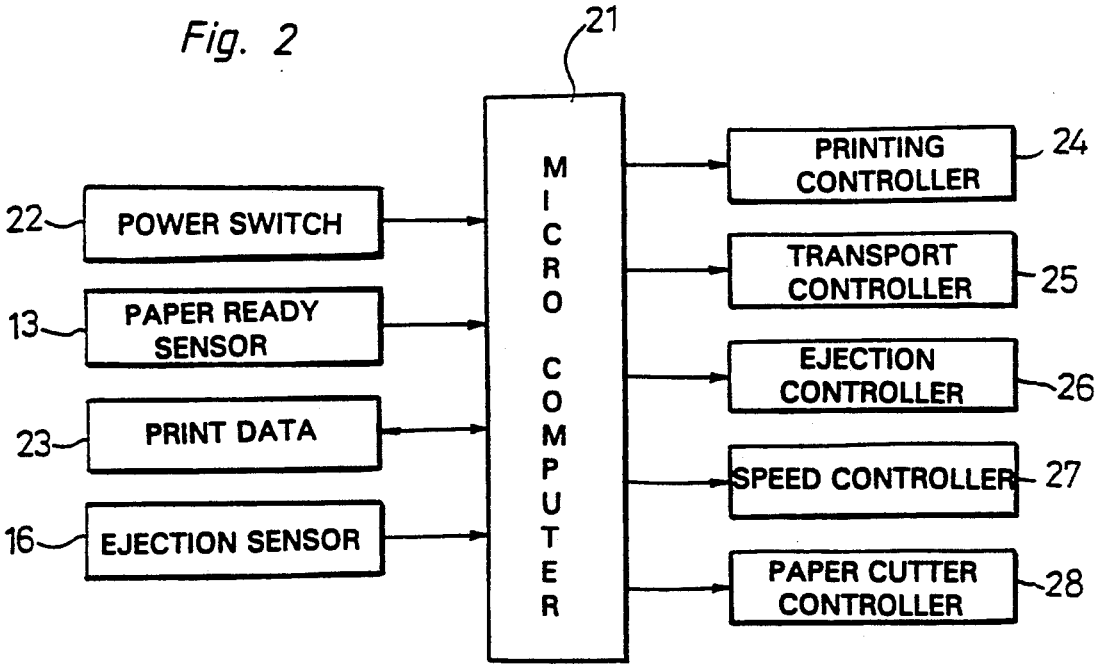
FIG. 2 is a block diagram of a control means according to the invention.

FIG. 2 illustrates the control means of the continuous paper electrophotographic printer of the invention. A microcomputer 21 is arranged to receive inputs from a power switch 22, a paper-ready sensor 13, an ejection sensor 16, and print data register 23. Output ports of the microcomputer 21 are connected for controlling the operation of: an electrophotographic printing control means 24, which controls the activation and deactivation of the light-sensitive drum 4, the LED head 5 and the electrophotographic transfer element 6; a transport control means 25 which controls the activation and deactivation of the transport drive roller 7; an ejection control means 26 which controls the activation and deactivation of the ejection drive roller 14; and a cutting control means 27 which controls the activation and deactivation of the movable blade 12.

Figure 3:
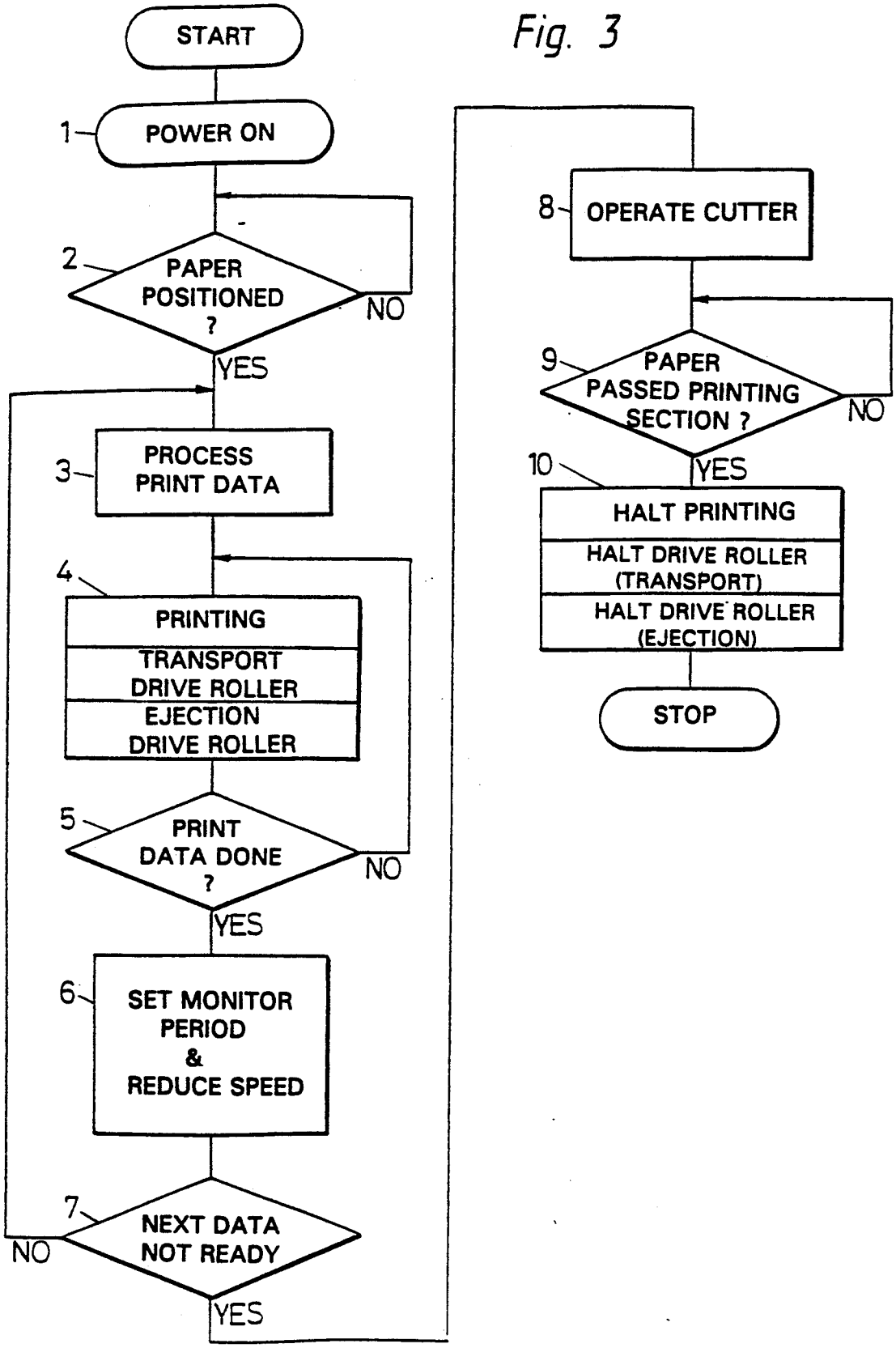
FIG. 3 is a flow chart illustrating the operation of the invention.

The continuous paper electrophotographic printer operates in accordance with a program stored in a ROM (not shown) of the microcomputer 21. The main routines of this program, which are illustrated in the flow chart of FIG. 3, operate as follows.

In response to an appropriate input from power switch 22, power is switched on for the system at step 1. At step 2 it is determined whether or not the paper 1 is ready to be transported, by interrogating the status of the paper-ready sensor 13. If the answer is No, the leading edge of the paper 1 is fed to the rollers 7 and 8, either manually or by an autoloading mechanism (when the apparatus is equipped with such a mechanism).

If in step 2 the answer is Yes, the process advances to step 3, at which step input print data is processed. Examples of such print data are price information that is printed on price tags that are attached to individual items of merchandise, parcel address information, and so forth. One hundred labels might need to be printed with print data A, for example,-followed by 50 labels with print data B.

When processing of the print data A has been completed, in step 4 the electrophotographic control means 24, transport control means 25 and ejection control means 26 activate the electrophotographic printing section 3 and the transport drive roller 7 to feed the paper 1 to the electrophotographic printing section 3. The ejection drive roller 14 is also activated to eject the paper 1 from the electrophotographic printing section 3.

Imprinting with the electrophotographic printing section 3 involves rotating the light-sensitive drum 4, energizing and de-energizing the LED head 5, and activating the electrophotographic transfer element 6.

During a printing operation, the speed of rotation of the light-sensitive drum 4, the transport drive roller 7 and the ejection roller 14 is set by the speed control means 27 to a comparatively high speed, dependent upon the capability of the printer apparatus.

Individual elements of the LED head 5 are selectively energized in accordance with line print data information to thus form characters on the labels. The position at which the printing of each label starts can be controlled, for example, by signals output by position sensors (not shown) which detect inter-label spaces.

After the printing of each item of print data, it is determined at step 5 whether printing of the entire set of print data A has been completed. If it has been and, as in the example described above, the printing of the set of print data A is to be followed by the printing of another set B, the process goes back to step 4. If there is no more data to be printed, the process moves on to step 6 at which step a prescribed monitoring time period (3 seconds, for example) is set, during which the speed of rotation of the light-sensitive drum 4, the transport drive roller 7 and the ejection roller 14 is reduced by the speed control means 27 to a speed that is sufficiently slow, as compared to the speed of rotation during printing operations, to prevent the paper 1 being scorched by heat generated by the printer elements (not shown) positioned on the downstream side of the electrophotographic transfer element 6.

In step 7, it is determined whether the next print data set B has not been readied within the monitoring time period. If the answer is No, that is, if inputting of the print data B has been completed, the process goes back to step 3. Also, the speed of rotation of the light-sensitive drum 4, the transport drive roller 7 and the ejection roller 14 is set to the higher speed used for printing operations.

If the next print data has been readied within the aforementioned time period, the process moves on to step 8 at which the cutting control means 28 operates the movable blade 12 to cut the paper 1. Next, in step 9, it is determined when the trailing edge of the cut paper 1 has passed the electrophotographic printing section 3, which occurs upon the detection of no more paper at the ejection sensor 16. If in step 9 the answer is Yes, the process moves on to step 10 at which step the overall operation of the system is halted by stopping the electrophotographic printing section 3, the transport drive roller 7 and the ejection drive roller 14.

Even after the monitoring time period is over and the paper has been cut, the transport drive roller 7 continues to be driven until the trailing edge of the cut paper passes the position of the ejection sensor 16. But since the paper has been cut, this rotation of the drive roller 7 does not cause more paper to be fed from the reel 2.

The light-sensitive drum 4 of the electrophotographic printing section 3, the transport drive roller 9 and the ejection drive roller 14 may all be driven from the same power source.

Although the above embodiment has been described with reference to continuous paper consisting of a continuous backing sheet to which labels are detachably adhered, it is not necessarily so limited; ordinary continuous paper may be used instead. Also, the printed characters or the like may be formed on the light-sensitive drum 4 of the electrophotographic printing section by a laser beam instead of by LEDs, or by light from a light-source which is controlled by a liquid-crystal shutter arrangement. A take-up reel for the printed paper may be provided downstream for receiving and cutting the paper into label units or print frame units.

In the continuous-paper electrophotographic printer according to the present invention, a printing operation is followed by a set monitoring time period for checking the readiness of a next set of print data, and during this period the speed of rotation of the light-sensitive drum and of the paper transport drive roller and paper eject roller is decreased to a speed that is below the speed of rotation used for printing operations. The reduced speed is such that, during the monitoring time period, scorching and needless transporting of paper are avoided and the printer rapidly proceeds to the next printing operation when inputting of the next data to be printed is completed within the monitoring time period.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A continuous-paper electrophotographic printer, comprising:

printing means which is activatable for imprinting selected information on continuous paper;

continuous-paper feeding means for supplying and transporting continuous paper to the printing means;

means for supplying to the printing means sets of data to be imprinted;

control means for interposing a monitoring time period for checking the readiness of each successive set of data to be imprinted; and said continuous paper feeding means including means for feeding the paper to the printing means at a first comparatively high speed during activation of the printing means and at a second lower speed during the monitoring time period.

2. The printer of claim 1, wherein said monitoring time period is about 3 seconds.

3. The printer of claim 1, wherein the printing means comprises a light-sensitive drum.

4. The printer of claim 3, wherein the printing means further comprises an LED head.

5. The printer of the claim 4, wherein the printing means further comprises an electrophotographic transfer element.

6. The printer of claim 1, wherein the continuous paper feeding means comprises a transport drive roller and a reel for holding a supply of continuous paper, the transport drive roller being disposed between the reel and the printing means.

7. The printer of claim 6, further comprising means for cutting the paper, the paper cutting means being disposed between the reel and the printing means.

8. The printer of claim 1, wherein the control means comprises a microcomputer and speed control means, responsive to the microcomputer, the control means being effective for controlling the transport drive roller and thereby the speed of feeding of the continuous paper.

9. A method for imprinting information on continuous-paper in a electrophotographic printer, the method comprising the steps of:

providing printing means which is activatable for imprinting selected information on continuous paper;

providing a continuous-paper feeding means and supplying and transporting therewith continuous paper to the printing means;

supplying to the printing means sets of data to be imprinted;

interposing a monitoring time period between the imprinting of the continuous paper with successive ones of sets of data to be imprinted and checking the readiness of each successive set of data to be imprinted; and feeding the paper to the printing means at a first comparatively high speed during activation of the printing means and at a second lower speed during the monitoring time period.

* * * * *